US007902758B2

(12) United States Patent
Woodward et al.

(10) Patent No.: US 7,902,758 B2
(45) Date of Patent: Mar. 8, 2011

(54) POWER SUPPLY SYSTEM AND METHOD FOR AUTOMOTIVE LED LIGHTING SYSTEMS

(75) Inventors: Ronald O. Woodward, Yorktown, VA (US); Jamie A. MacDonald, Cambridge (CA)

(73) Assignee: Decoma International Inc., Concord, Ontario (CA)

( * ) Notice: Subject to any disclaimer, the term of this patent is extended or adjusted under 35 U.S.C. 154(b) by 345 days.

(21) Appl. No.: 11/658,280

(22) PCT Filed: Jul. 25, 2005

(86) PCT No.: PCT/US2005/026572

§ 371 (c)(1), (2), (4) Date: Apr. 24, 2009

(87) PCT Pub. No.: WO2006/012633

PCT Pub. Date: Feb. 2, 2006

(65) Prior Publication Data

US 2010/0007277 A1 Jan. 14, 2010

Related U.S. Application Data

(60) Provisional application No. 60/590,958, filed on Jul. 23, 2004.

(51) Int. Cl.
*H05B 37/02* (2006.01)

(52) U.S. Cl. ..... 315/82; 315/223; 315/307; 307/10.8

(58) Field of Classification Search ..... 315/82, 315/307, 308, 224, 223, 291; 307/10.8
See application file for complete search history.

(56) References Cited

U.S. PATENT DOCUMENTS

| | | | |
|---|---|---|---|
| 4,160,934 | A | 7/1979 | Kirsch |
| 5,661,374 | A | 8/1997 | Cassidy et al. |
| 6,414,437 | B1 | 7/2002 | Diez et al. |
| 6,538,394 | B2 | 3/2003 | Volk et al. |
| 6,693,394 | B1 | 2/2004 | Guo et al. |
| 6,747,420 | B2 | 6/2004 | Barth et al. |
| 6,798,152 | B2 | 9/2004 | Rooke et al. |
| 2004/0080273 | A1 | 4/2004 | Ito et al. |

FOREIGN PATENT DOCUMENTS

| | | | |
|---|---|---|---|
| EP | 0 586 734 | B1 | 3/1994 |
| WO | WO 03/017729 | A1 | 2/2003 |

OTHER PUBLICATIONS

International Search Report and Written Opinion for PCT/US2005/026572 Dated Dec. 20, 2005.

*Primary Examiner* — David Hung Vu
(74) *Attorney, Agent, or Firm* — Clark Hill PLC

(57) ABSTRACT

An automotive lighting assembly receiving light from a power source and for producing light. The automotive lighting assembly includes a first lighting circuit which is operatively connected to the power source for emitting light as a function of electric current. A second lighting circuit is operatively connected to the power source independently from the first lighting circuit. The second lighting circuit emits light as a function of the electric current. The automotive lighting assembly also includes a controller which is electrically connected between the power source and the first and second lighting circuits for independently operating the first and second lighting sources to emit a chosen amount of light in a chosen direction.

9 Claims, 5 Drawing Sheets

POWER SUPPLY SYSTEM AND METHOD FOR AUTOMOTIVE LED LIGHTING SYSTEMS

FIELD OF THE INVENTION

The invention relates to supplying controlled power to an automotive lighting assembly. More specifically, the invention relates to a power supply and method for powering automotive headlight assembly.

BACKGROUND OF THE INVENTION

Automotive lighting assemblies are increasingly making use of light emitting diodes (LEDs) as light sources due to their reliability, power efficiency and minimal production levels of thermal energy as a byproduct, as compared to incandescent light sources. With improvements in LEDs, it has recently become possible to construct high output devices, such as headlamp assembly, using LEDs as the sole light source.

While LEDs do offer advantages over other light sources, such as incandescent or gas discharge sources, they also have some weaknesses. In particular, LEDs are susceptible to overvoltages, wherein too much voltage is applied to their semiconductor junctions, resulting in too much current flowing through the junctions, damaging the LED and shortening its life. Also, if too little current is supplied, LEDs produce less light (fewer lumens) and the lighting assembly may not output sufficient lumens to meets safety and/or regulatory requirements. As a further complication, the appropriate voltage/current levels for LEDs change with the temperature at which the LEDs are operated. All of these issues are further exacerbated when the LEDs are high output types, such as those which would be desired for use in headlight assembly.

As automotive electrical assembly typically experience relatively wide voltage swings and as automotive assemblies typically must operate over wide temperature ranges and conditions, to date it has been difficult to provide appropriate electrical power to LED light sources.

To date, the power supply assemblies employed for high output automotive LED assemblies have been serial supply assemblies wherein the LEDs are configured serially across the power supply, as this required the power supply to regulate a single voltage, across which all the LEDs appeared. While serial power supplies do minimize the expense of the power supplies, they suffer from the fact that, if one or more LEDs in the series circuit are damaged resulting in an open circuit, the lighting assembly will cease to illuminate. Conversely, when one or more LEDs in the circuit are damaged and short the circuit, the remaining LEDs in the circuit will be subject to an over-current and will have a decreased lifetime, at best. Also, each LED used in an assembly has its own unique operating characteristics in an assembly, due to fabrication process differences in manufacturing the LED and/or the operating conditions experienced by the LED, such as how well it is cooled in the assembly. Serial power supplies inevitably treat all of the LEDs in the serial circuit the same, thus averaging the individual LEDs' characteristics with the result that some LEDs will be overdriven and some underdriven.

It is desired to have a power supply for LED-based automotive lighting assembles, particularly high output lighting assemblies such as headlight assemblies, which is not subject to these problems.

SUMMARY OF THE INVENTION

It is an object of the invention to provide a novel power supply assembly and method for an automotive LED lighting assembly which obviates or mitigates at least one disadvantage of the prior art.

According to a first aspect of the present invention, there is provided an automotive lighting assembly. An automotive lighting assembly receiving light from a power source and for producing light. The automotive lighting assembly includes a first lighting circuit which is operatively connected to the power source for emitting light as a function of electric current. A second lighting circuit is operatively connected to the power source independently from the first lighting circuit. The second lighting circuit emits light as a function of the electric current. The automotive lighting assembly also includes a controller which is electrically connected between the power source and the first and second lighting circuits for independently operating the first and second lighting sources to emit a chosen amount of light in a chosen direction.

BRIEF DESCRIPTION OF THE DRAWINGS

Preferred embodiments of the present invention will now be described, by way of example only, with reference to the attached Figures, wherein.

DETAILED DESCRIPTION OF THE INVENTION

Figure 1:
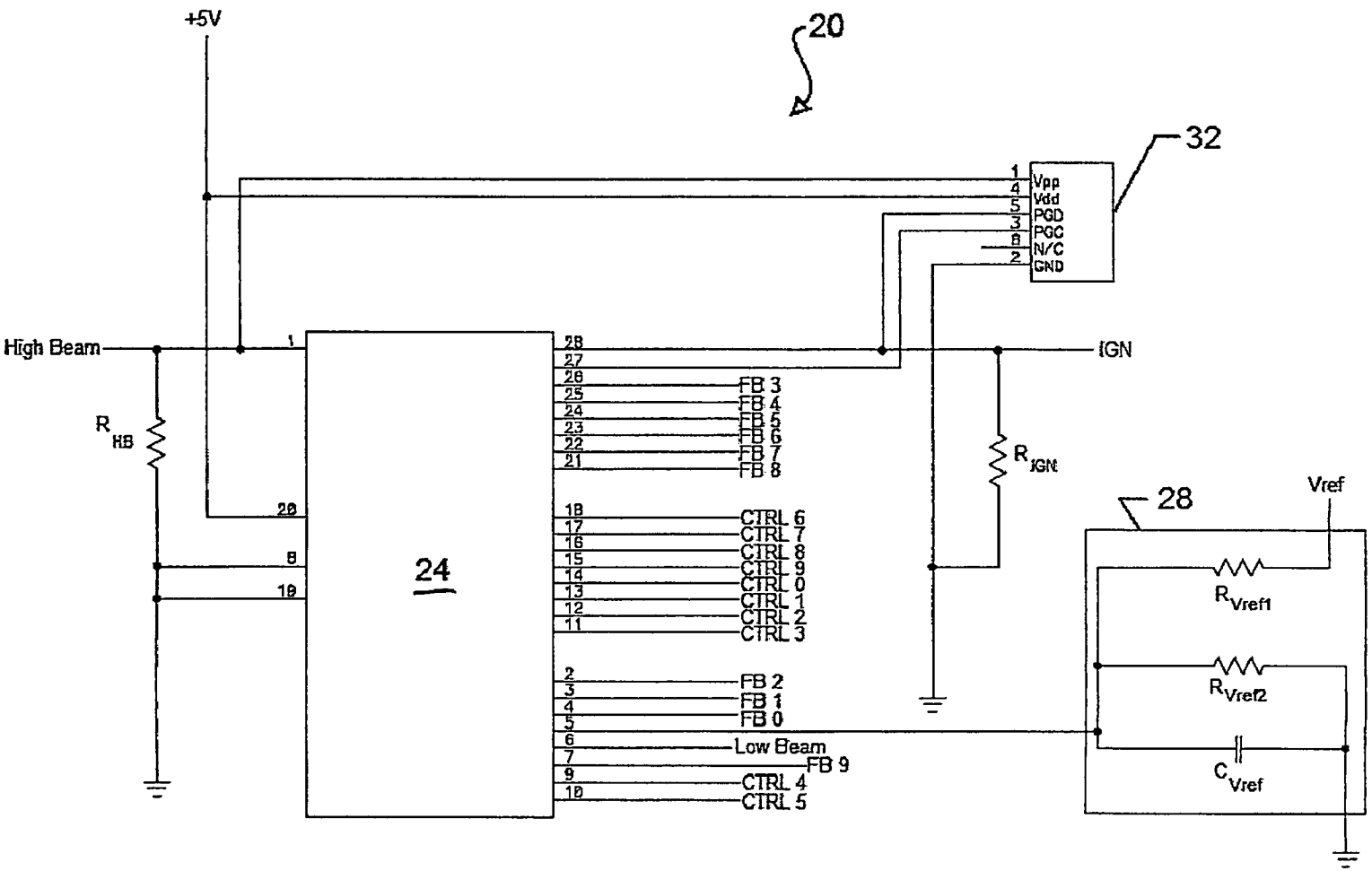
FIG. 1 is a schematic diagram of a portion of an automotive lighting assembly including a power supply in accordance with the present invention.
Figure 2A:
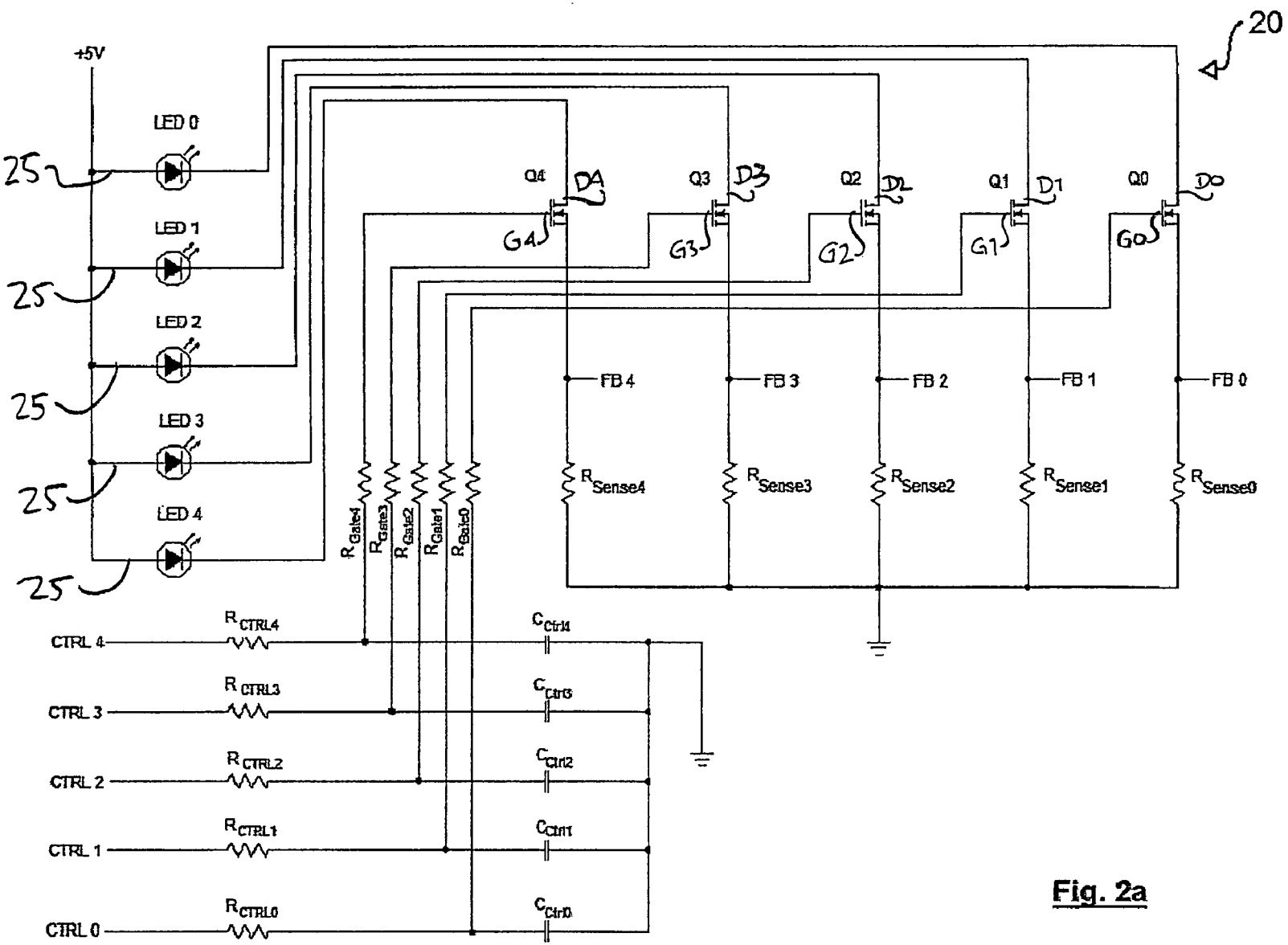
FIGS. 2A and 2B are a schematic representation of another portion of the lighting assembly of FIG. 1.
Figure 2B:
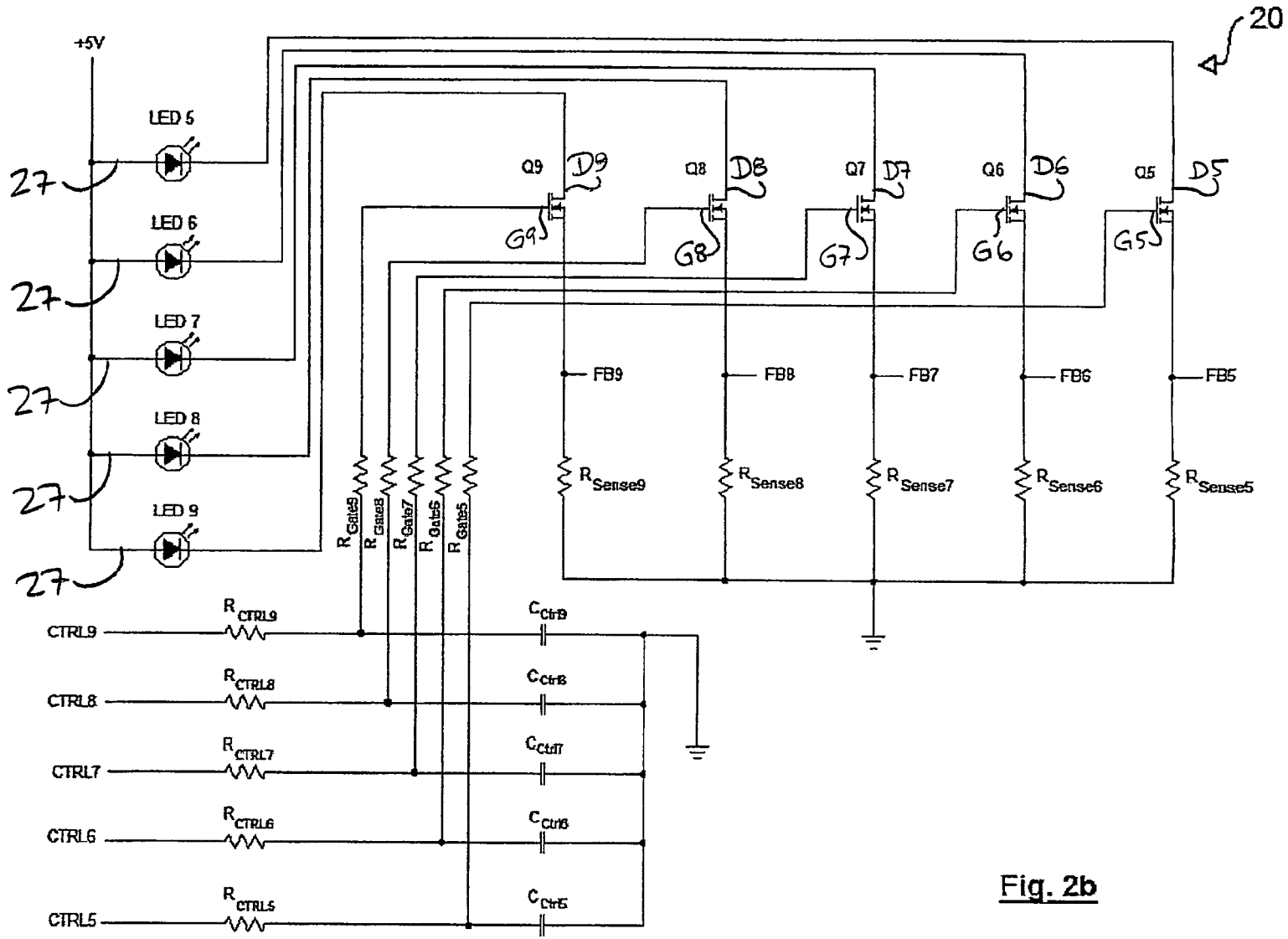

An automotive lighting assembly is indicated generally at 20 in FIGS. 1, 2A and 2B. As shown in FIG. 1, the automatic lighting assembly 20 includes a controller 24 which, in a present embodiment, is 16F737 PIC microcontroller manufactured by Microchip Technology Inc. of Chandler, Ariz. The microcontroller 24 is supplied with five volts of power, from a power source, not shown, and has a set often output control lines, labeled CTRL0 through CTRL9, and ten input feedback lines, labeled FB0 through FB9. In addition, the microcontroller 24 has three mode inputs: IGN, for detecting a control signal indicating that the automobile's ignition system has been activated; High Beam, for detecting a control signal that the lighting assembly 20 is to operate in high beam mode; and Low Beam, for detecting a control signal indicating that the lighting assembly 20 is to operate the low beam mode.

As will be apparent to those of skill in the art, appropriate control signals to these three mode inputs can be used to place the lighting assembly 20 into a variety of modes, including Low Beam mode, wherein just the Low Beam input is active and the Low Beam LEDs are illuminated by the lighting assembly 20, High Beam, wherein both the Low Beam and High Beam inputs are active and the High Beam and Low Beam LED elements are illuminated by the lighting assembly 20 and Daytime Running Light Mode, wherein just the High Beam input is active and the High Beam LEDs are illuminated, with a reduced current to reduce the output thereof.

A reference voltage circuit 28, provides a reference voltage Vref to the microcontroller 24, which is used by the analog to digital converters in the microcontroller 24. An optional pin header 32 can be provided to allow the microcontroller 24 to be programmed or reprogrammed at, or after, assembly. Alternatively, the microcontroller 24 can have its program embedded in an onboard ROM, or an external ROM as will occur to those of skill in the art.

Referring now to FIGS. 2A and 2B, a portion of the lighting circuits 25, 27 of the automotive lighting assembly 20 are illustrated. In the Figures, only ten lighting circuits 25, 27, along with their related circuitry, are illustrated for clarity. As will be apparent to those of skill in the art, more or fewer lighting circuits 25, 27 can be including in the automatic lighting assembly 20, as desired, and multiple instances of the automatic lighting assembly 20 can be included in a vehicle.

Each lighting circuit 25, 27 includes a lighting element, Q0 through LED9, connected between a five volt DC power supply (+5V) and the drain of a respective transistor, Q0 through Q9. In the embodiment shown, each transistor Q0-Q9 is a MOSFET. The lighting elements are LEDs Q0-Q9. The source of each respective transistor Q0-Q9 is connected to a respective current sensing resistor $R_{Sense0}$ through $R_{Sense9}$, which are, in turn, connected to ground. As will be apparent to those skilled in the art, by altering the voltage applied to a gate G0-G9 of each transistor Q0-Q9, the voltage across, and thus the current through, each respective LED Q0-Q9 can be controlled, as described below and by measuring the voltage across sense resistors $R_{Sensor0}$-$R_{Sense9}$, the current through those resistors, and hence through the respective Q0-Q9, can be determined as the values of the sense resistors $R_{Sense0}$-$R_{Sense9}$ are known.

The gate G0 of the transistor Q0 is connected through a gate resistor, $R_{Gate0}$, to a point between a current limiting control resistor $R_{CTRL0}$ and a charge storage capacitor $C_{Ctrl0}$. The other side of the capacitor $C_{Ctrl0}$ is connected to ground and the other side of the resistor $R_{CTRL0}$ is connected to the CTRL0 output of the microcontroller 24. Preferably, the outputs of the microcontroller 24 are tri-state outputs and can be set high, low or can be allowed to float.

If the CTRL0 output is set too high, for example to +5V, then current flows through the control resistor $R_{CTRL0}$ and charges the control capacitor $C_{Ctrl0}$. When the control capacitor $C_{Ctrl0}$ is charged, a voltage is applied, through the gate resistor $R_{Gate0}$, to the gate G0 of the transistor Q0 with a proportionate amount of current flowing from the +5V power supply, through Q0, Q0 and $R_{Sense0}$ to ground.

If the CRTL0 output is set to low, for example 0V, then the control capacitor $C_{Ctrl0}$ discharges through the first control resistor $R_{CTRL0}$ and the voltage applied to the gate G0 of the transistor Q0, through the first gate resistor $R_{Gate0}$, is reduced or eliminated and a proportionate reduction in the current flowing through the first LED Q0 occurs.

If the CRTL0 output is set to float, then the charge in the first control capacitor $C_{Ctrl0}$ is preserved, except for the parasitic losses through the gate G0 of the first transistor Q0 via the first gate resistor $R_{Gate0}$. These losses are quite small. The gates G1-G9 of each other respective transistor Q1-Q9 are connected to respective control outputs CTRL1 through CTRL9 via identical circuitry.

To determine the actual voltage and/or current being applied to the first LED Q0, a first feedback input FB0 of the microcontroller 24 is connected to a feedback point between the first drain D0 of the first transistor Q0 and the first sense resistor $R_{Sense0}$. An analog to digital converter in the microcontroller 24 samples the voltage at the feedback point and, knowing the value of the first sense resistor $R_{Sense0}$, the microcontroller 24 can determine the current flowing through the first LED Q0. Similar connections are provided between respective feedback inputs FB1-FB9 and the drains D1-D9 of the transistors Q1 -Q9 to allow the microcontroller 24 to determine the current flowing through respective LEDs Q1-Q9.

An example of the operation of automotive lighting assembly 20 will now be described. In this example, the LEDs Q0-Q4 represent the light sources for the low beam operating mode of an automotive headlamp. When the vehicle ignition switch is turned on, the IGN input to the microcontroller 24 is active and the microcontroller 24 is activated. A self check and initialization operation can be performed and all of control outputs CTRL0-CTRL9 are initially set to Active Low (0V) levels. Next, the microcontroller 24 checks for any active input signals of interest, such as the High Beam, or Low Beam inputs. In this example, we assume that the Low Beam input signal is active, indicating that the headlight should be illuminated in the Low Beam mode.

The microcontroller 24 will then sequentially determine the current through each LED Q0-Q9 by sampling the voltage at the appropriate feedback point, at the respective feedback input, and comparing it to a preselected value. The microcontroller 24 can store one or more tables of appropriate preselected values for the LEDs Q0-Q9 under different modes and/or configurations. For example, in High Beam male, the LEDs Q5-Q9 which are to be illuminated to provide the high beam can have a first preselected value defined for them and in Daytime Running Light mode, wherein these same LEDs Q5-Q9 are illuminated, albeit at a reduced level of brightness, a second preselected value will be defined for them. As will be apparent to those of skill in the art, if it is desired to avoid hysteresis in the sample and compare process, a "plus or minus" factor, hereinafter an "epsilon", can be introduced to the comparison process. Specifically, a sampled value can be considered to be equal to the preselected value, if the values differ by less than the epsilon. The particular value for epsilon can be determined in any of a variety of known manners and a single epsilon value can be stored in the microcontroller 24 for all comparisons, or different epsilons can be stored in the microcontroller 24 for the comparisons performed in different operating modes. For clarity, the following discussion omits the use of an epsilon, but the operation of automotive lighting assembly 20 with an epsilon will also be apparent to those of skill in the art from this discussion.

Commencing with the first LED Q0, the microcontroller 24 samples the voltage at F130 and compares it to the appropriate preselected value for the operating mode and determines that the sampled value is less than the preselected value (it is zero as the LED Q0 is not illuminated at startup). Accordingly, the control output CTRL0 is set to Active High (+5V) by the microcontroller 24, which results in the first control capacitor $C_{Ctrl0}$ being charged through the first control resistor $R_{CTRL0}$, thus applying a voltage to the gate G0 of the first transistor Q0 through the first gate resistor $R_{Gate0}$.

The method of selecting values for the resistors $R_{CTRL}$, $R_{Gate}$ and $R_{Sense}$ and for the control capacitors $C_{Ctrl0}$-$C_{Contrl9}$ will be apparent to those of skill in the art and will depend upon, amongst other factors, upon the Active High and Active Low voltage levels employed, the operating characteristics of the transistors Q0-Q9 employed and the time period within which the microcontroller 24 processes each LED Q0-Q9 to set the respective CTRL output as an Active High, Active Low or float.

Once the first LED Q0 has been processed, the microcontroller 24 proceeds to determine the current through the next LED Q1. The microcontroller 24 samples the voltage at input FB1 from the corresponding feedback point and compares it to the appropriate preselected value and determines that the sampled value is less than the preselected value. The microcontroller 24 sets the control output CTRL1 to Active High, which results in the second control capacitor $C_{Ctrl1}$ being charged through the second control resistor $R_{CTRL1}$, thus applying a voltage to a gate G1 of the second transistor Q1 through the second gate resistor $R_{Gate1}$.

The microcontroller 24 then processes the remaining LEDs Q2, Q3 and Q4 in a similar manner. As voltages are applied to gates G0-G4 of the transistors Q0 through Q4, the control capacitors $C_{Ctrl0}$-$C_{Ctrl4}$ are charged and the transistors Q0-Q9 begin to conduct, allowing current to pass through their respective LEDs Q0-Q9. When the microcontroller 24 finishes processing the fifth LED Q4, it returns to reconsider the first LED Q0.

The microcomputer 24 again samples the voltage applied to input FB0 and compares it to the preselected value. If the sampled voltage is less than the preselected value, the control output CRTL0 is set to (or remains at) Active High to further charge the first control capacitor $C_{Ctrl0}$, raising the voltage applied through the first gate resistor $R_{Gate0}$ to the gate G0 of the transistor Q0 to raise its conductance further, increasing the current flowing through the first LED Q0. If the sampled voltage is higher than the preselected value, the control output CRTL0 is set to Active Low, removing charge from the first control capacitor $C_{Ctrl0}$ and decreasing the voltage applied to the gate G0 of the first transistor Q0 through the first gate resistor $R_{Gate0}$ and thus reducing the conductance of the first transistor Q0 to reduce the current flowing through the first LED Q0. If the sampled voltage is equal to the preselected value, the control CRTL0 is set to float, to substantially retain the charge in the first control capacitor $C_{Ctrl0}$ and thus maintain the voltage applied to the gate G0 of the first transistor Q0, to keep the current flowing through the first LED Q0 substantially constant.

After the microcomputer 24 has processed the first LED Q0, it in turn processes each of the second LED Q1 through the fifth LED Q4 in a similar manner and repeats the overall process continually until a change to the status of another input line, such as the IGN, High Beam or Low Beam inputs, is detected. By sampling the voltage and adjusting the conductance of the transistors Q1-Q4, the automotive lighting assembly 20 can accurately control the current passing through each LED Q1-Q4 and thus control the operation thereof.

In one embodiment, the different operating modes of automotive lighting assembly 20 can be defined by defining different tables of preselected values for each operating mode. For example, in the above-described Low Beam mode, the preselected values for the lighting elements creating the low beam (Q0 through Q4) can be set to the maximum normal operating voltage for the LEDs Q0-Q4, while the preselected values for the unused lighting elements Q5-Q9 can be set to 0V, thus effectively turning these LEDs off.

Similarly, to implement Daylight Running Light mode, the preselected values for the first five LEDs Q0 through Q4 can be set to 0V and the preselected values for the latter LEDs Q5-Q9 can be set to one half of their normal 2.5V (to provide a half-bright high beam). Thus, signals applied to the High Beam or Low Beam inputs of the microcontroller 24 can change the table of preselected values being used by the microcontroller 24 to change the operating mode of the automotive lighting assembly 20. As will be apparent to those of skill in the art, in this embodiment, the microcontroller 24 always processes each of LEDs Q0-Q9 in each mode.

The microcontroller 24 can also monitor the operation of the LEDs Q0-Q9 to detect at least some fault conditions. For example, the microcontroller 24 can monitor the operation of each LED Q0-Q9 to detect open circuit failures of an LED. In such as case, the microcontroller 24 is programmed such that it monitors the state of each LED where, if after a selected number of Active High output states have been asserted, the voltage at a respective feedback point is still 0V, then the microcontroller 24 deems the respective LED to have failed as an open circuit. The microcontroller 24 can produce a suitable error condition signal in such a case to appropriately notify the vehicle operator of the fault condition.

As the automotive lighting assembly 20 can detect open circuit failures of LEDs Q0-Q9, and as headlight systems are subject to safety regulations with respect to the output lumen levels, the automotive lighting assembly 20 can provide additional advantages over conventional lighting assemblies. For example, the automotive lighting assembly 20 can include one or more redundant LED lighting elements and lighting circuits which are not required to meet regulation lumen output levels. In such a case, these redundant LEDs can remain unused, until an open circuit failure of another LED is detected, in which case the automotive lighting assembly 20 can commence using one or more of the redundant LED in place of the failed unit so that automotive lighting assembly 20 still produces the regulated level of lumens.

Alternatively, the automotive lighting assembly 20 can operate all of the LEDs, including the redundant elements, at reduced operating levels but where the sum of the lumens produced by all of the operating LED meets the regulated levels of lumens. In this latter mode, by operating the LEDs at reduced currents, the expected lifetime thereof can be extended. Of course, in such a configuration in the event of a detected failure of one or more LEDs, the automotive lighting assembly 20 can increase the operating levels of the remaining LEDs to compensate, if possible, for the failed elements to produce the regulated lumen levels.

If no redundant LEDs are provided in the automotive lighting assembly 20, the automotive lighting assembly 20 can operate the remaining LEDs at levels above their normal current operating points to produce additional output lumens to attempt to meet the output lumen regulations, even though such over driving of the remaining lighting elements can reduce their expected lifetimes.

In the event of the failure of an LED, and especially in the case wherein the automotive lighting assembly 20 does not have redundant capacity and the headlight is not meeting the lumen output levels set by regulation and/or is overdriving lighting elements, the automotive lighting assembly 20 can also provide an appropriate error or warning condition signal to the operator of the vehicle to indicate that the headlamp is not operating correctly and should be serviced as soon as possible.

Figure 3:
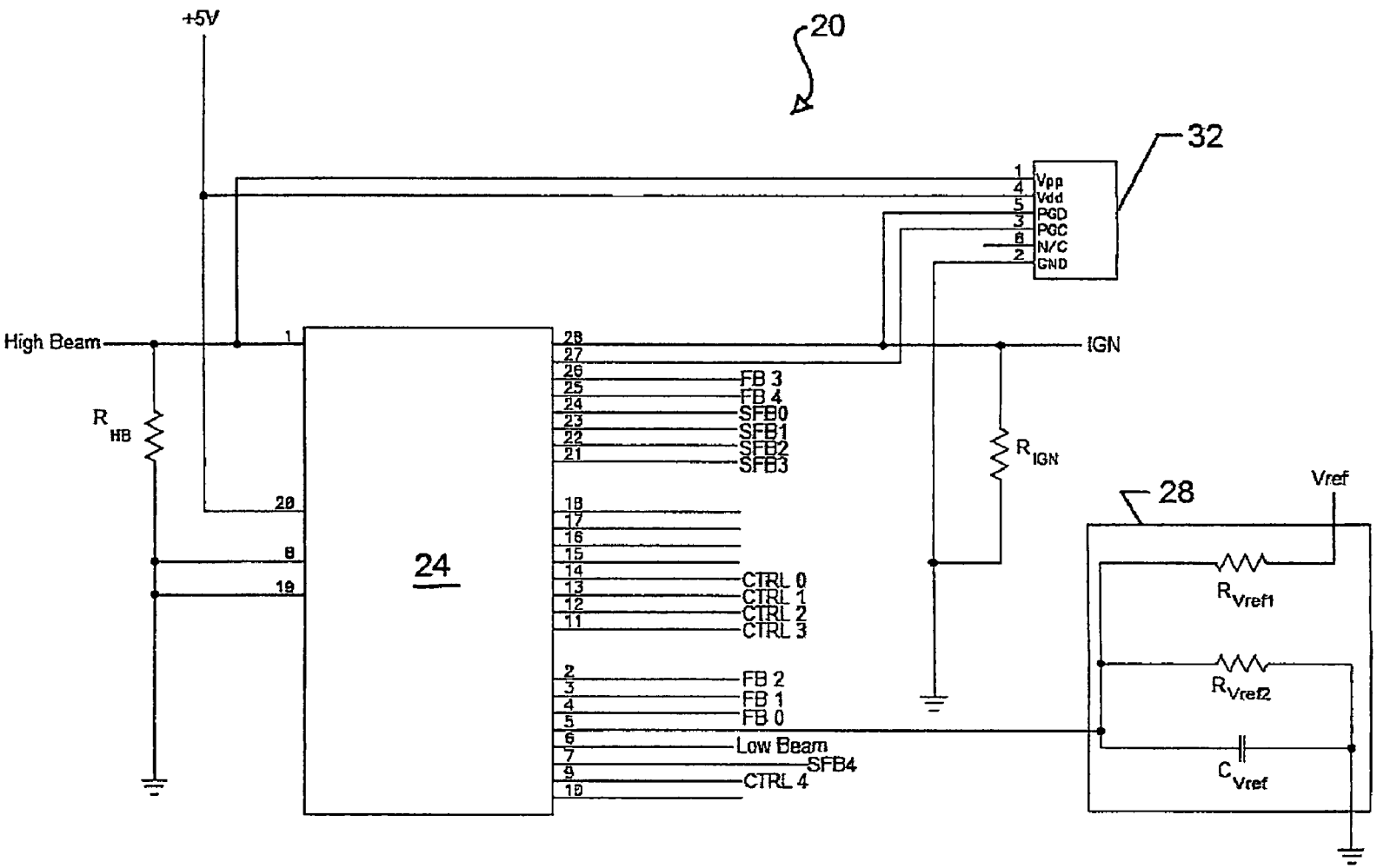
FIG. 3 is a schematic diagram of a portion of another embodiment of an automotive lighting assembly including a power supply in accordance with the present invention.
Figure 4:
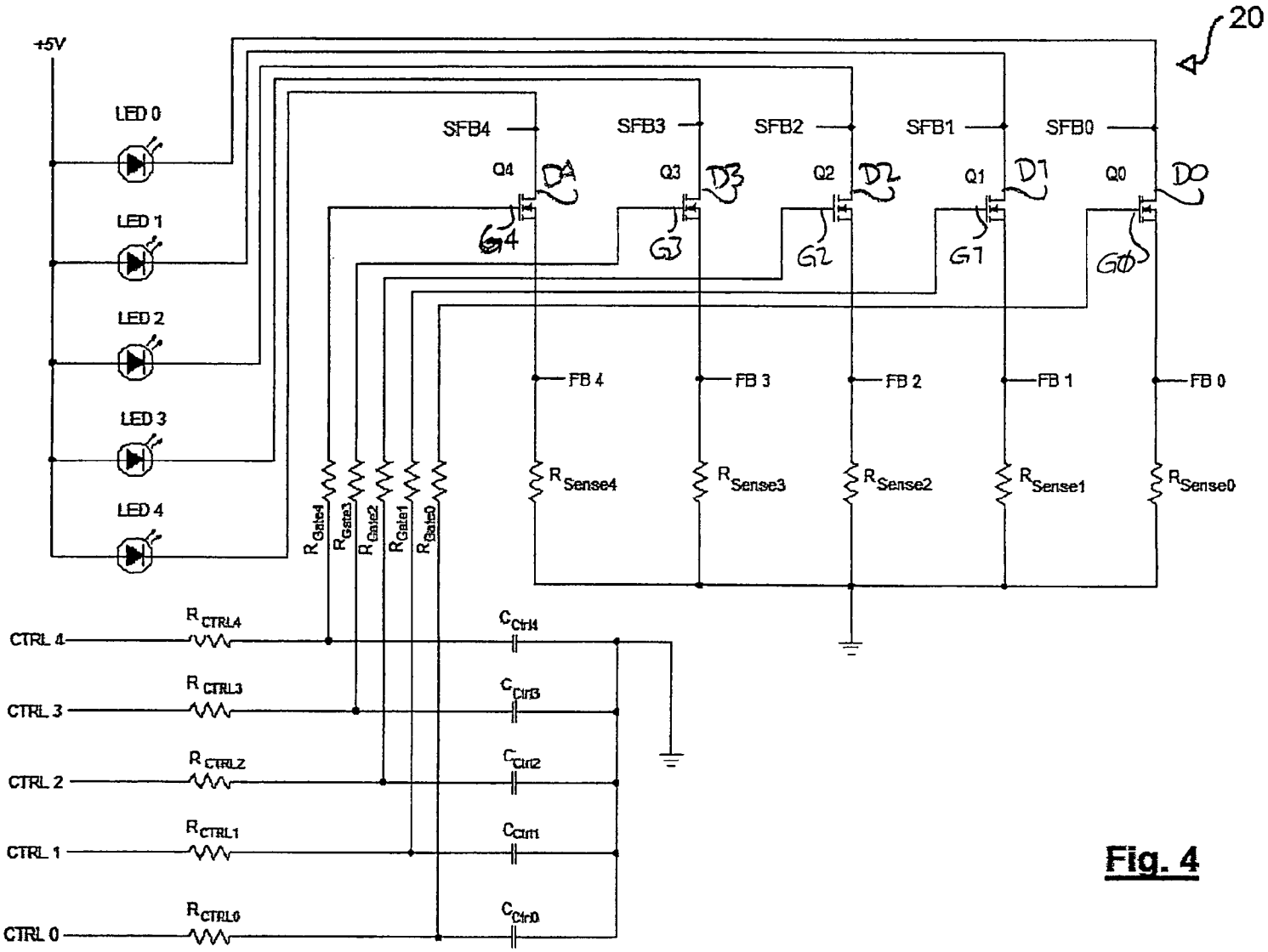
FIG. 4 is a schematic representation of another portion of the lighting assembly of FIG. 3.

FIGS. 3 and 4 show another embodiment of the invention. In this embodiment, a second feedback input, SBF0-SBF4, is provided for each LED Q0-Q4. For clarity, in the illustrated embodiment of FIGS. 3 and 4, the number of LEDs in the automotive lighting assembly 20 has been reduced to five, Q0-Q4 and the inputs to the microcontroller 24 which were used for the feedback signals FB5-FB9 in the embodiment of FIG. 1 are instead used as the inputs for the secondary feedback inputs SFB0-SFB4. As will be apparent to those of skill in the art, the invention is not limited to such a configuration and the selection and use of a microcontroller with additional inputs, or the use of two or more microcontrollers 24, or the use of a multiplexer or other mechanism to allow the microcontroller 24 to sample additional points in automotive lighting assembly 20 will allow more than five LEDs to be employed in this embodiment.

In the embodiment of FIGS. 3 and 4, the microcontroller 24 also samples, in turn, the voltage at each respective secondary feedback point when processing each LED. With a determination of the voltage at the secondary feedback point SBF and the feedback point FB, the microcontroller 24 can detect short circuit failures of an LED. If the microcontroller 24 determines that the sampled voltages at SBF and at FB are substantially the same, i.e., differ by no more than the expected voltage drop across the respective transistor, the microcontroller 24 will determine that the respective LED has failed in a short circuit mode and the microcontroller 24 can take appropriate action by setting the respective CTRL output to an Active Low, and will implement the appropriate predefined strategy for dealing with a failed LED from those strategies discussed above, i.e., illuminating a redundant LED, operating remaining elements at a higher output level and/or providing a warning message to the vehicle operator.

In addition to providing a mechanism whereby the automotive lighting assembly 20 can detect LEDs which have experienced a short circuit mode failure, the microcontroller 24 can use the difference in the sampled voltages at SBF and FB to detect the actual voltage drop across the LED. As the voltage drop across the junction of an LED is related to the junction temperature of the LED, the microcontroller 24 can determine the temperature of the junction with a reasonable degree of accuracy by, for example, using the voltage drop with a predefined lookup table of junction temperatures. As the junction temperature determines the lifetime of the LED and its light emitting efficiency, the microcontroller 24 can also employ this information in setting the operating current levels of the LEDs. For example, the microcontroller 24 can increase the current to an LED when its junction temperature increases above a preselected point, to offset the drop in light output as the junction operates less efficiently at higher temperatures, and, if the junction temperature continues to increase above a second preselected point, the microcontroller 24 can decrease the current to the LED to prevent damage to the LED and the microcontroller 24 can provide a suitable error message to the operator of the vehicle that the headlamp or other LED is not functioning correctly.

As the automotive lighting assembly 20 provides control of individual LEDs, in addition to the above-mentioned features and capabilities, the automotive lighting assembly 20 also provides various other features. For example, many automobiles presently provide an automated headlamp shutdown with a delay, to allow the driver to exit the vehicle and a garage, for example, with the headlights still illuminated. One concern many drivers have with such assemblies is that there is no indication provided to the driver that the delay assembly is operating and that the headlights will in fact shut off after he has left the garage. With the invention, an input can be provided to the microcontroller 24 to indicate that the automated shut down with delay has been activated and the microcontroller 24 can, at defined intervals, dim and turn off first one LED, then a second and a third, etc. to provide a visual indication to the driver that the headlight will shut down as expected. As will occur to those of skill in the art, various other features and effects can be achieved, including providing "styling effects" such as illuminating a single lighting element at a time in the automotive lighting assembly 20 and switching which LED is illuminated to "scan" the light from side to side of a headlamp.

While in the discussions above, each lighting circuit 25, 27 only contains a single LED, the invention is not so limited and one or more of the controlled lighting circuits can include two or more LEDs. In such a case, the LEDs of a lighting circuit can be connected in serial, parallel or serial and parallel configurations between the source of a respective transistors and sensing resistors. In such a configuration, the microcontroller 24 still controls the current through the lighting circuit, essentially treating the combination of lighting elements as a lumped device. As will be apparent to those of skill in the art, in such a case if serial configurations are employed, the source voltage applied to the drains of the transistors Q0-Q9 can be higher than the 5V discussed in the embodiments above.

The above-described embodiments of the invention are intended to be examples of the present invention and alterations and modifications may be effected thereto, by those of skill in the art, without departing from the scope of the invention which is defined solely by the claims appended hereto.

We claim:

1. An automotive lighting assembly receiving light from a power source and for producing light, said automotive lighting assembly comprising:

a first lighting circuit operatively connected to the power source for emitting light as a function of electric current;

a second lighting circuit operatively connected to the power source independently from said first lighting circuit, said second lighting circuit emitting light as a function of the electric current; and a controller electrically connected between the power source and said first and second lighting circuits for independently operating said first and second lighting sources to emit a chosen amount of light in a chosen direction;

wherein each of said first and second lighting circuits includes a lighting element electrically connected to a drain of a transistor, and each of said first and second lighting circuits includes a resistor electrically connected to a source of said transistor and ground, said first and second lighting circuits further including a capacitor operatively connected between ground, said controller and a gate of said transistor to regulate voltage levels at said gate based on charged stored by said capacitors.

2. An automotive lighting assembly as set forth in claim 1 including a reference voltage circuit for comparing voltage from said controller against a predetermined threshold.

3. An automotive lighting assembly as set forth in claim 2 wherein each of said lighting elements includes a light emitting diode.

4. An automotive lighting assembly as set forth in claim 2 wherein one of said first and second lighting circuits emits a high beam.

5. An automotive lighting assembly as set forth in claim 4 wherein the other of said first and second lighting circuits emits a low beam.

6. An automotive lighting assembly as set forth in claim 5 including a feedback loop for sensing the voltage across each of said resistors.

7. An automotive lighting assembly as set forth in claim 6 wherein said feedback loop is electrically connected to said controller.

8. An automotive lighting assembly as set forth in claim 7 wherein said feedback loop includes a first and second feedback circuits electrically connected to said first and second lighting circuits, respectively.

9. An automotive lighting assembly as set forth in claim 8 wherein each of said first and second lighting circuits includes a plurality of lighting elements.

* * * * *